US008077898B2

(12) United States Patent
Huang

(10) Patent No.: US 8,077,898 B2
(45) Date of Patent: Dec. 13, 2011

(54) DUAL-FREQUENCY COAXIAL EARPHONES

(75) Inventor: Fred Huang, Taoyuan (TW)

(73) Assignee: Jetvox Acoustic Corp., Taoyuan (TW)

( * ) Notice: Subject to any disclaimer, the term of this patent is extended or adjusted under 35 U.S.C. 154(b) by 809 days.

(21) Appl. No.: 12/216,638

(22) Filed: Jul. 9, 2008

(65) Prior Publication Data

US 2009/0279729 A1 Nov. 12, 2009

(30) Foreign Application Priority Data

May 8, 2008 (TW) ..... 97207948 U

(51) Int. Cl.
*H04R 1/20* (2006.01)

(52) U.S. Cl. ..... 381/345; 381/335; 381/346; 381/370; 381/186

(58) Field of Classification Search ..... None
See application file for complete search history.

(56) References Cited

U.S. PATENT DOCUMENTS 3,821,492 A * 6/1974 Tamura et al. ..... 381/191
3,984,885 A * 10/1976 Yoshimura et al. ..... 381/309
4,058,688 A * 11/1977 Nishimura et al. ..... 381/372
4,965,836 A * 10/1990 Andre et al. ..... 381/370
5,109,424 A * 4/1992 Andre et al. ..... 381/384
6,215,887 B1 * 4/2001 Wei et al. ..... 381/424
6,404,896 B1 * 6/2002 Yoo et al. ..... 381/401
7,266,214 B2 * 9/2007 Tsuda ..... 381/415
7,324,655 B2 * 1/2008 Sato ..... 381/370
2005/0105758 A1 * 5/2005 Tsuda ..... 381/415
2006/0098838 A1 * 5/2006 Yoo ..... 381/398
2006/0165249 A1 * 7/2006 Sato ..... 381/374

* cited by examiner

*Primary Examiner* — Marlo Fletcher
(74) *Attorney, Agent, or Firm* — Bacon & Thomas, PLLC

(57) ABSTRACT

A dual-frequency coaxial earphone includes a frame, a shared yoke, a high frequency speaker part, and a low frequency speaker part. The high frequency speaker part and the low frequency speaker part are coaxially arranged at inside and outside of the shared yoke, and are coaxial with a central opening of the frame. Further, a permanent magnet of the higher frequency speaker part is contrary, in polarity, to an annular magnet of the low frequency speaker part. Therefore, acoustic frequency of the low frequency speaker part can be phase-countered by passing thereof through an acoustic annular recess, so that the acoustic frequency of the low frequency speaker part has the same phase as the acoustic frequency of the high frequency speaker part and both then are output synchronally. The high frequency speaker part and the low frequency speaker part can then be separated, in acoustic frequency, from each other. This will effectively solve the problem of intermodulation of distortion for the high and low acoustic frequencies, and reduce the size of the earphone to more compact.

7 Claims, 6 Drawing Sheets

DUAL-FREQUENCY COAXIAL EARPHONES

BACKGROUND OF THE INVENTION

1. Field of the Invention

The present invention relates to a structure for earphones, and more particularly, to a structure for dual-frequency coaxial earphones.

2. Description of Related Art

Referring to FIG. 1, a cross-sectional view illustrating a conventional earphone, the earphone 9 comprises a case 90, a cord 91, a diaphragm 92, a permanent magnet 93, a voice coil 94, a pole piece 95, and a yoke 96.

As shown in FIG. 1, the cord 91, the diaphragm 92, the permanent magnet 93, the voice coil 94, the pole piece 95, and the yoke 96 are received in the case 90, respectively, wherein the voice coil 94 is disposed on the diaphragm 92 and surrounds the permanent magnet 93, while maintains a gap, radially, with the pole piece 95. The permanent magnet 93 is interposed between the pole piece 95 and the yoke 96.

The cord 91 is electrically connected with the voice coil 94, so that when acoustic frequency signal is transmitted to the voice coil 94 via the cord 91, the voice coil 94 produces a magnetic field due to a magnetic effect. The magnetic field will then magnectically interact with the pole piece 95, making the diaphragm 92 vibrated and the acoustic frequency signal converted into and outputting an acoustic frequency wave.

Conventionally, an acoustic frequency signal involves a high frequency speaker part and a low frequency speaker part. Therefore, vibration of a diaphragm produces, simultaneously, a high acoustic frequency wave and a low acoustic frequency wave. However, since the high and low frequency acoustic waves involve characteristics of different wavelengths and amplitudes, respectively, the diaphragm cannot distinguish clearly the characteristics from one another. As such, the conventional earphone results in a shortage of intermodulation of distortion for the high and low acoustic frequencies, and fails to produce a clear sound. To overcome the shortage, if a high frequency speaker and a low frequency speaker are arranged together in an earphone, a bulk size will make the earphone impractical.

SUMMARY OF THE INVENTION

The present invention is to provide a dual-frequency coaxial earphone, comprising a frame, a shared yoke, a high frequency speaker part, and a low frequency speaker part.

The frame includes a front board and a peripheral wall, wherein the peripheral wall surrounds the front board, and interior of the peripheral wall and interior of the front board are enclosed with each other and formed together a receiving space. The front board is provided with a central opening and a plurality of acoustic holes, which are communicated, respectively, with the receiving space. The plural acoustic holes are equidistantly arranged on at least a part of the front board and around the central opening.

The shared yoke has a cap-like shape, is disposed in the receiving space of the frame, and includes a crown portion and a band portion. The band portion is provided around the crown portion, and is fixed to the interior of the front board. The crown portion is arranged, coaxially, to the central opening of the front board and remote from the front board. The crown portion includes a concave.

The high frequency speaker part includes a permanent magnet, a pole piece, a high-frequency voice coil, and a high-frequency diaphragm, wherein the permanent magnet is received in the crown portion of the shared yoke and is interposed between the pole piece and the concave of the shared yoke; and wherein the high-frequency voice coil is disposed on the high-frequency diaphragm and surrounds the pole piece, while maintains a gap, radially, with the pole piece. The high-frequency diaphragm is received in the central opening of the front board.

The low frequency speaker part includes an annular magnet, an annular pole piece, a low-frequency voice coil, and a low-frequency diaphragm. The annular magnet encircles the crown portion of the shared yoke, and is interposed between the annular pole piece and the band portion of the shared yoke. The annular magnet and the permanent magnet of the high frequency speaker part have different polarities countering each other. The low-frequency voice coil is disposed on the low-frequency diaphragm, and is received in the annular pole piece, while maintains a gap, radially, from the annular pole piece. The low-frequency diaphragm is disposed in the interior of the peripheral wall of the frame.

The shared yoke and the low frequency speaker part are smaller, respectively, in exterior, than the interior of the peripheral wall of the frame, and are spaced from each other by an acoustic annular recess which is communicated with the plural acoustic holes of the frame.

In the present invention, the high frequency speaker part and the low frequency speaker part are coaxially arranged at inside and outside of the shared yoke, and are coaxial with the central opening of the frame. Further, the permanent magnet of the higher frequency speaker par is contrary, in polarity, to the annular magnet of the low frequency speaker part. Therefore, the acoustic frequency of the low frequency speaker part can be phase-countered by passing thereof through the acoustic annular recess, so that the acoustic frequency of the low frequency speaker part has the same phase as the acoustic frequency of the high frequency speaker part and both then are output synchronally. The high frequency speaker part and the low frequency speaker part can then be separated from each other in acoustic frequency. This will effectively solve the problem of intermodulation of distortion for the high and low acoustic frequencies, and reduce the size of the earphone to be more compact.

Further, the dual-frequency coaxial earphone comprises a case and a cord. The case may include an earplug, or a headset. Moreover, the dual-frequency coaxial earphone may further comprise a circuit board, or a frequency divider.

Still further, in the present invention, the high-frequency diaphragm may include an internal ring and an external ring, wherein the high-frequency voice coil is disposed in the internal ring, and the external ring is disposed in the front board and around the central opening. The low-frequency diaphragm includes an internal ring and an external ring, wherein the low-frequency voice coil is disposed in the internal ring, and the external ring is disposed in the interior of the peripheral wall. The dual-frequency coaxial earphone may further comprise a fixing ring, disposed in the interior of the peripheral wall, for fixing the low-frequency diaphragm.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
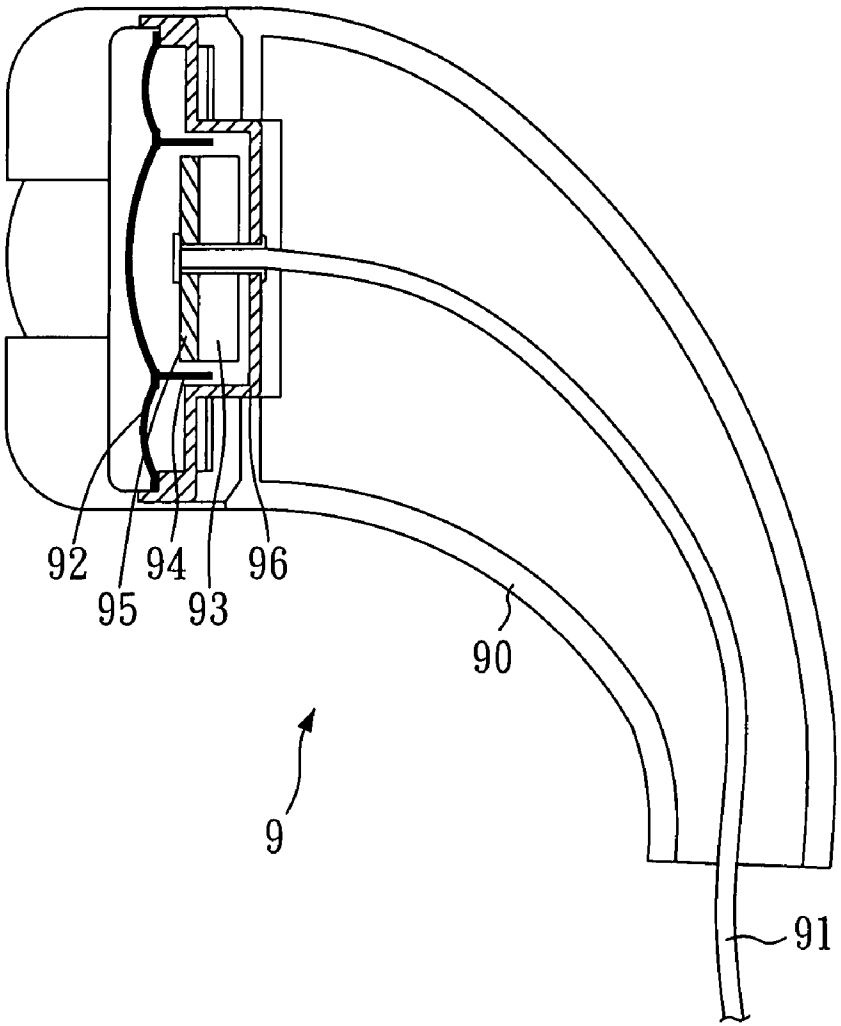
FIG. 1 (PRIOR ART)
FIG. 1 is a cross-sectional view illustrating a conventional earphone.
Figure 2:
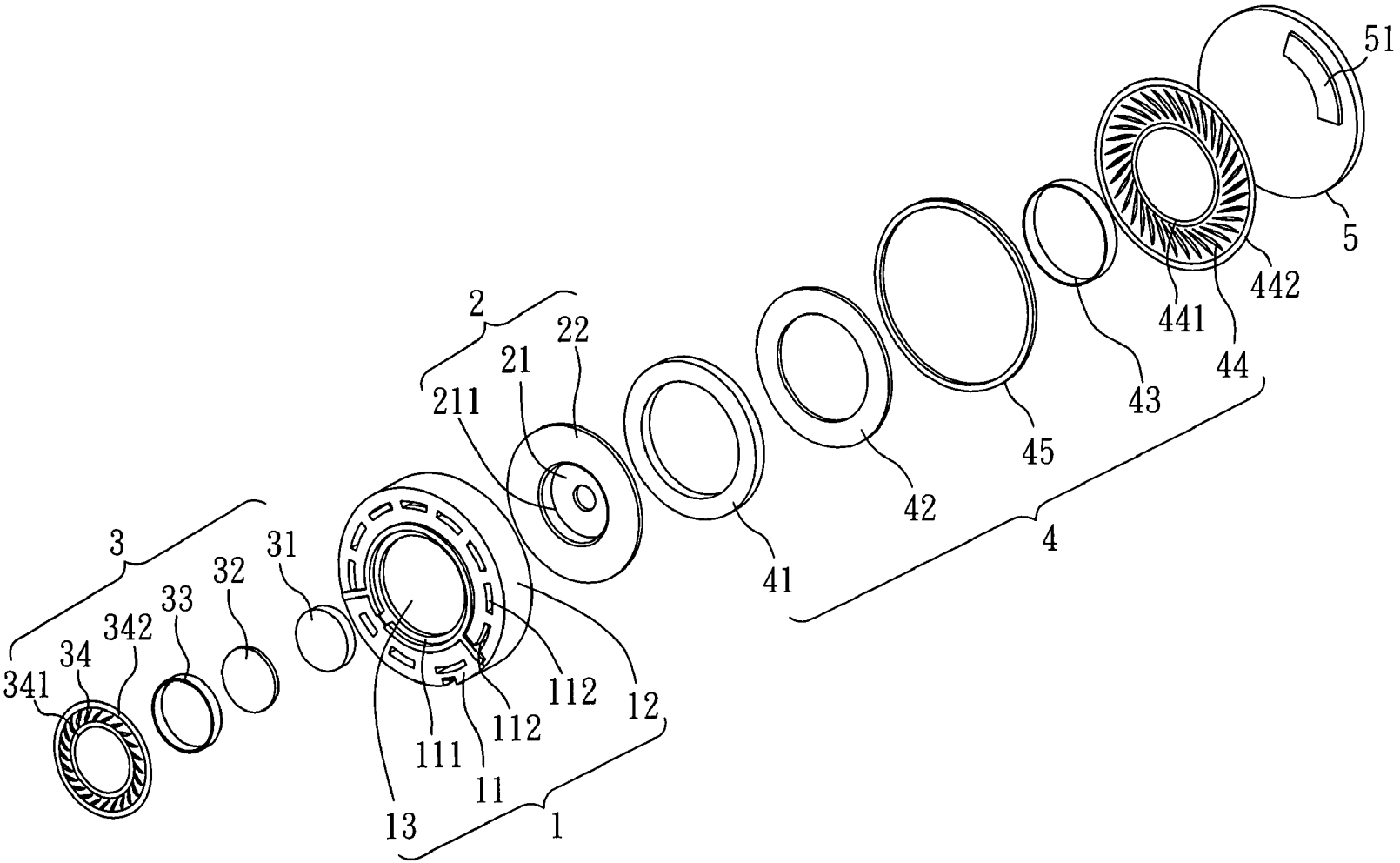
FIG. 2 is an exploded view illustrating an earphone according to a first embodiment of the present invention.
Figure 3:
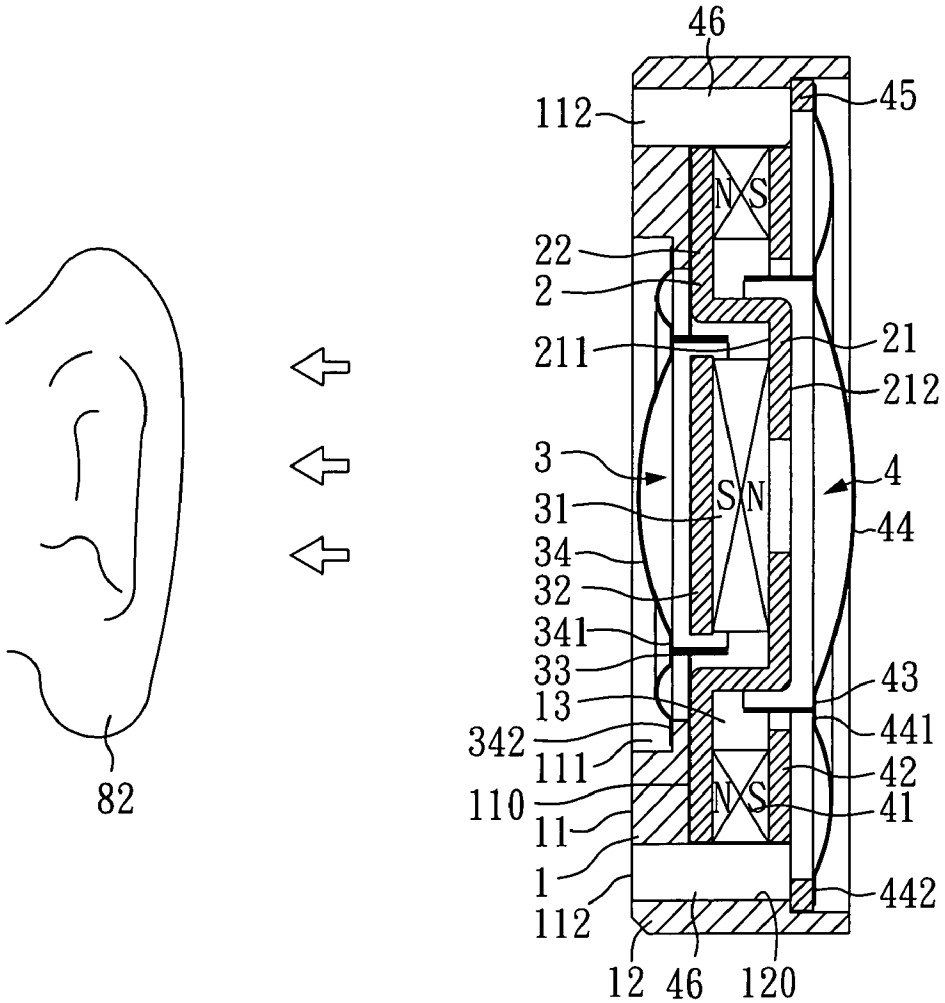
FIG. 3 is a cross-sectional view illustrating the earphone according to the first embodiment of the present invention.

Referring to FIGS. 2 and 3, an exploded view and a cross-sectional view illustrating an earphone according to a first embodiment of the present invention, a dual-frequency coaxial earphone comprises a frame 1, a shared yoke 2, a high frequency speaker part 3, and a low frequency speaker part 4.

The frame 1 includes a front board 11 and a peripheral wall 12, wherein the peripheral wall 12 surrounds the front board 11, and interior 120 of the peripheral wall 12 and interior 110 of the front board 11 are enclosed with each other and formed together a receiving space 13. The front board 11 is provided with a central opening 111 and a plurality of acoustic holes 112, which are communicated, respectively, with the receiving space 13. The plural acoustic holes 112 are equidistantly arranged on at least a part of the front board 11 and around the central opening 111.

The shared yoke 2 has a cap-like shape, is disposed in the receiving space 13 of the frame 1, and includes a crown portion 21 and a band portion 22. The band portion 22 is provided around the crown portion 21, and is fixed to the interior 110 of the front board 11. The crown portion 21 is arranged, coaxially, to the central opening 111 of the front board 11 and remote from the front board 11. The crown portion 21 includes a concave 211 and a convex 212.

The high frequency speaker part 3 includes a permanent magnet 31, a pole piece 32, a high-frequency voice coil 33, and a high-frequency diaphragm 34, wherein the permanent magnet 31 is received in the crown portion 21 of the shared yoke 2 and is interposed between the pole piece 32 and the concave 211 of the shared yoke 2; and wherein the high-frequency voice coil 33 is disposed on the high-frequency diaphragm 34 and surrounds the pole piece 32, while maintains a gap, radially, with the pole piece 32 so as to strengthen and concentrate magnetism of the permanent magnet 31 on and between the high-frequency voice coil 33 and the pole piece 32. The high-frequency diaphragm 34 is received in the central opening 111 of the front board 11.

In the present embodiment, the high-frequency diaphragm 34 includes an internal ring 341 and an external ring 342, wherein the high-frequency voice coil 33 is disposed in the internal ring 341, and the external ring 342 is disposed in the front board 11 and around the central opening 111.

The low frequency speaker part 4 includes an annular magnet 41, an annular pole piece 42, a low-frequency voice coil 43, and a low-frequency diaphragm 44. The annular magnet 41 encircles the crown portion 21 of the shared yoke 2, and is interposed between the annular pole piece 42 and the band portion 22 of the shared yoke 2. The annular magnet 41 and the permanent magnet 31 of the high frequency speaker part 3 have different polarities countering each other. The low-frequency voice coil 43 is disposed on the low-frequency diaphragm 44, received in the annular pole piece 42, and is located in between the annular pole piece 42 and the crown portion 21 of the shared yoke 2, while maintains a gap, radially, from the annular pole piece 42 so as to strengthen and concentrate magnetism of the annular magnet 41 on and between the low-frequency voice coil 43 and the annular pole piece 42. The low-frequency diaphragm 44 is disposed in the interior 120 of the peripheral wall 12 of the frame 1.

In the present embodiment, the low-frequency diaphragm 44 includes an internal ring 441 and an external ring 442, wherein the low-frequency voice coil 43 is disposed in the internal ring 441, and the external ring 442 is disposed in the interior 120 of the peripheral wall 12.

The shared yoke 2 and the low frequency speaker part 4 are, in exterior, smaller than the interior 120 of the peripheral wall 12, and are spaced from each other by an acoustic annular recess 46 which is communicated with the plural acoustic holes 112 of the frame 1.

According to the present invention, as shown in FIG. 2, the dual-frequency coaxial earphone further comprises a circuit board 5 which is disposed on the frame 1. Still, the dual-frequency coaxial earphone further comprises a frequency divider 51 which is provided for dividing a mixed acoustic input signal into a high-frequency output signal and a low-frequency output signal which are used, respectively, by the high-frequency voice coil 33 and the low-frequency voice coil 43. Preferably, the frequency divider 51 is integrally arranged on the circuit board 5 so as to achieve the purpose of compact and lightweight.

As shown in FIGS. 2 and 3, the dual-frequency coaxial earphone, according to the present invention, includes a fixing ring 45, disposed in the interior 120 of the peripheral wall 12, for fixing the low-frequency diaphragm 44.

Taking the ear 82 of a listener for reference basis, as shown in FIG. 3, polarity of the permanent magnet 31 of the higher frequency speaker part 3 is S-N, whereas on the contrary, polarity of the annular magnet 41 of the low frequency speaker part 4 is N-S. However, acoustic frequency of the low frequency speaker part 4 can be phase-countered by passing thereof through the acoustic annular recess 46, so that the acoustic frequency of the low frequency speaker part 4 has the same phase as the acoustic frequency of the high frequency speaker part 3 and both then are output synchronally.

In the present embodiment, the high frequency speaker part 3 and the low frequency speaker part 4 are coaxially arranged on the shared yoke 2, and on the concave 211 and the convex 212 of the crown portion 21, and are coaxial with the central opening 111 of the frame 1. Further, the permanent magnet 31 of the higher frequency speaker part 3 is contrary, in polarity, to the annular magnet 41 of the low frequency speaker part 4. Therefore, the acoustic frequency of the low frequency speaker part 4 can be phase-countered by passing thereof through the acoustic annular recess 46, so that the acoustic frequency of the low frequency speaker part 4 has the same phase as the acoustic frequency of the high frequency speaker part 3 and both then are output synchronally. The high frequency speaker part 3 and the low frequency speaker part 4 can then be separated, in acoustic frequency, from each other. This will effectively solve the problem of intermodulation of distortion for the high and low acoustic frequencies, and reduce the size of the earphone to more compact.

Figure 4:
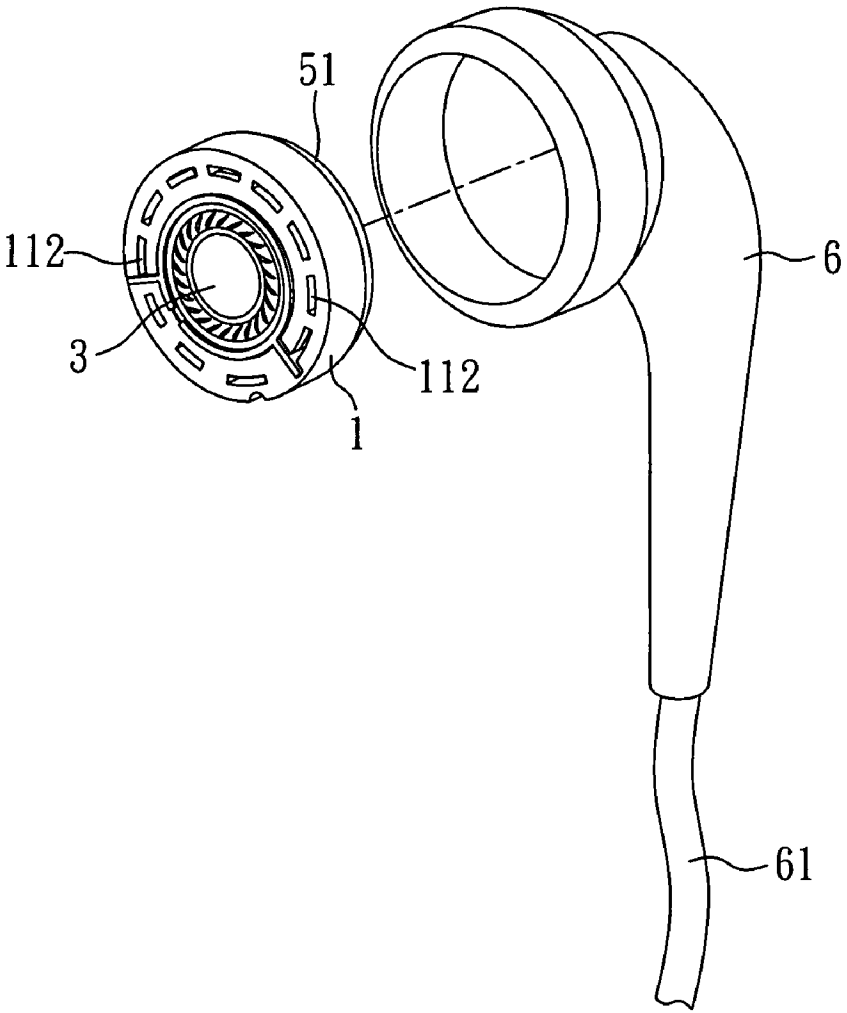
FIG. 4 is a perspective view illustrating the earphone according to the first embodiment of the present invention.

Now referring to FIG. 4, a perspective view illustrating the earphone according to the first embodiment of the present invention, the dual-frequency coaxial earphone further comprises a case 6 and a cord 61. The case 6 receives the frame 1, and that the cord 61 is electrically connected with the frequency divider 51 so as to provide the frequency divider 51 a mixed acoustic input signal.

Figure 5:
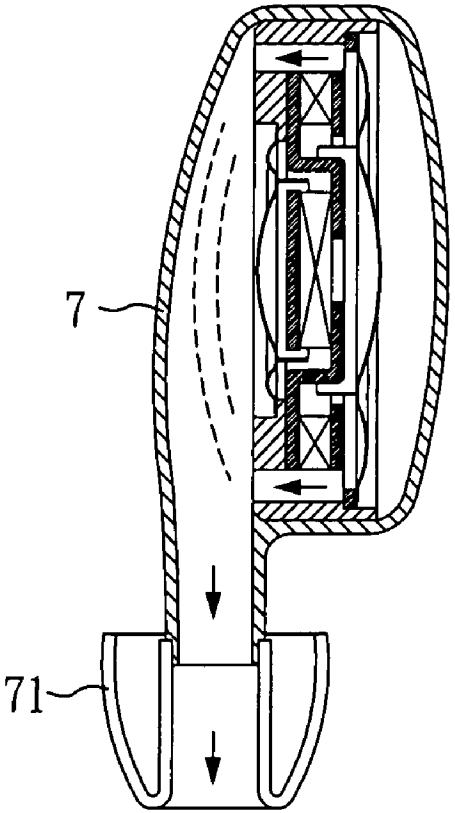
FIG. 5 is a cross-sectional view illustrating an earphone according to a second embodiment of the present invention.

Further, referring to FIG. 5, a cross-sectional view illustrating an earphone according to a second embodiment of the present invention, this embodiment is similar, in structure, to the first embodiment, except that the case falls in an earplug-type case 7, so that an earplug 71 is included.

Figure 7:
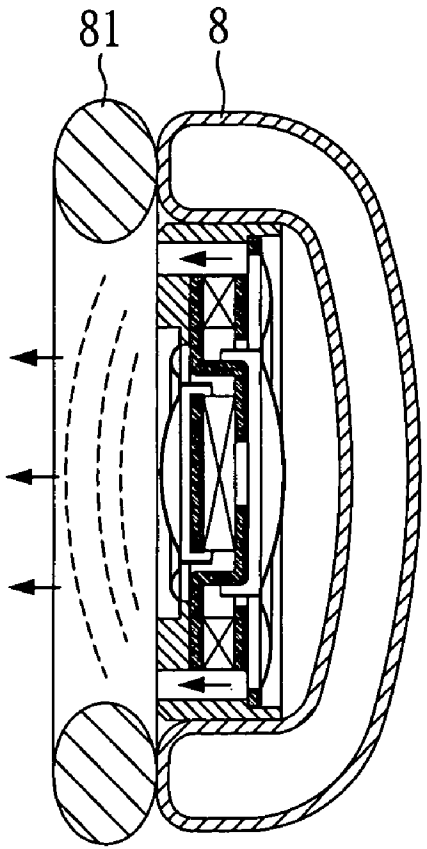
FIG. 7 is a cross-sectional view illustrating the earphone according to the third embodiment of the present invention.
Figure 6:
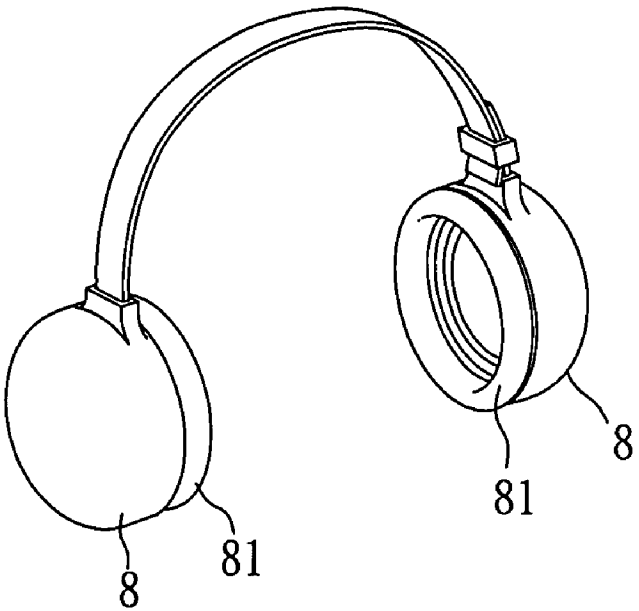
FIG. 6 is a perspective view illustrating an earphone according to a third embodiment of the present invention.

Still further, referring to FIGS. 6 and 7, a perspective view and a cross-sectional view illustrating an earphone according to a third embodiment of the present invention, the third embodiment is similar, in structure, to the first embodiment, except that the case falls in a headset-type case 8, so that a headset 81 is included.

Although the present invention has been explained in relation to its preferred embodiments, it is to be understood that many other possible modifications and variations can be made without departing from the scope of the invention as hereinafter claimed.

What is claimed is:

1. A dual-frequency coaxial earphone, comprising:

a frame, including a front board and a peripheral wall, wherein the peripheral wall surrounds the front board, and interior of the peripheral wall and interior of the front board are enclosed with each other and formed together a receiving space, and wherein the front board is provided with a central opening and a plurality of acoustic holes, which are communicated, respectively, with the receiving space, such that the plural acoustic holes are equidistantly arranged on at least a part of the front board and around the central opening;

a shared yoke, having a cap-like shape, being disposed in the receiving space of the frame, and including a crown portion and a band portion, wherein the band portion is provided around the crown portion, and is fixed to the interior of the front board, and wherein the crown portion is arranged, coaxially, to the central opening of the front board and remote from the front board, and the crown portion includes a concave;

a high frequency speaker part, including a permanent magnet, a pole piece, a high-frequency voice coil, and a high-frequency diaphragm, wherein the permanent magnet is received in the crown portion of the shared yoke and is interposed between the pole piece and the concave of the shared yoke, and the high-frequency voice coil is disposed on the high-frequency diaphragm and surrounds the pole piece, while maintaining a radial gap with the pole piece, and the high-frequency diaphragm includes an internal ring and an external ring, wherein the high-frequency voice coil is disposed in the internal ring, and the external ring is disposed on the front board of the frame; and a low frequency speaker part, including an annular magnet, an annular pole piece, a low-frequency voice coil, and a low-frequency diaphragm, wherein the annular magnet encircles the crown portion of the shared yoke and is interposed between the annular pole piece and the band portion of the shared yoke, and the annular magnet and the permanent magnet of the high frequency speaker part have different polarities countering each other, and wherein the low-frequency voice coil is disposed on the low-frequency diaphragm, and is received in the annular pole piece, while maintaining a radial gap from the annular pole piece, and the low-frequency diaphragm includes an internal ring and an external ring, and the low-frequency voice coil is disposed in the internal ring, and the external ring is disposed on the peripheral wall of the frame;

whereby, the shared yoke and the low frequency speaker part are smaller, respectively, than the peripheral wall of the frame, and are spaced from each other by an acoustic annular recess which is communicated with the plural acoustic holes of the frame.

2. The dual-frequency coaxial earphone as claimed in claim 1, further comprising a case and a cord.

3. The dual-frequency coaxial earphone as claimed in claim 2, wherein the case includes an earplug.

4. The dual-frequency coaxial earphone as claimed in claim 2, wherein the case includes a headset.

5. The dual-frequency coaxial earphone as claimed in claim 1, further comprising a circuit board.

6. The dual-frequency coaxial earphone as claimed in claim 1, further comprising a frequency divider.

7. The dual-frequency coaxial earphone as claimed in claim 1, further comprising a fixing ring, disposed in the interior of the peripheral wall of the frame.

* * * * *